US010352583B2

(12) United States Patent
Carton et al.

(10) Patent No.: US 10,352,583 B2
(45) Date of Patent: Jul. 16, 2019

(54) PANEL FOR AN AIR HANDLING UNIT, METHOD FOR ASSEMBLING SUCH A PANEL, AND AIR HANDLING UNIT INCLUDING SUCH A PANEL

(71) Applicant: Carrier Corporation, Farmington, CT (US)

(72) Inventors: Thomas Carton, Eloise (FR); Samuel Duchet, Lyons (FR); Bertrand Jacquin, Saint Maximin (FR); Marc Serra, Andert Et Condon (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/558,500

(22) PCT Filed: Mar. 9, 2016

(86) PCT No.: PCT/US2016/021517
§ 371 (c)(1),
(2) Date: Sep. 14, 2017

(87) PCT Pub. No.: WO2016/149000
PCT Pub. Date: Sep. 22, 2016

(65) Prior Publication Data

US 2018/0080678 A1 Mar. 22, 2018

(30) Foreign Application Priority Data

Mar. 18, 2015 (FR) ..... 15 52235

(51) Int. Cl.
*F24F 13/20* (2006.01)
*F24F 13/06* (2006.01)
(Continued)

(52) U.S. Cl.
CPC ..... *F24F 13/20* (2013.01); *F24F 3/0442* (2013.01); *F24F 13/06* (2013.01); *F24F 13/0245* (2013.01);
(Continued)

(58) Field of Classification Search
CPC ..... F24F 12/20; F24F 3/0442; F24F 11/04; F24F 13/06; F24F 11/053; F24F 13/222;
(Continued)

(56) References Cited

U.S. PATENT DOCUMENTS 4,747,505 A * 5/1988 Hansen ..... E04H 1/1238 220/4.28
5,056,290 A * 10/1991 Alexander ..... E04B 1/6116 52/309.11
(Continued)

FOREIGN PATENT DOCUMENTS

EP 2487429 A1 8/2012
WO 2012097908 A1 7/2012

OTHER PUBLICATIONS

Translation of EP 2487429 to Klaus et al.*
International Search Report and Written Opinion for application PCT/US2016/021517, dated May 19, 2016, 10pgs.

*Primary Examiner* — David J Teitelbaum
(74) *Attorney, Agent, or Firm* — Cantor Colburn LLP

(57) ABSTRACT

This panel (6) for an air handling unit defines a main axis (X6) perpendicular to its surface and includes at least two first plates (8), each provided with at least two folded-over edges, and at least two second plates (10), each provided with at least two folded-over edges. The plates are parallel to one another and perpendicular to the main axis of the panel. The panel includes at least one internal joining element (14) inserted between the first and second plates along the main axis.

8 Claims, 8 Drawing Sheets

(51) Int. Cl.
*F24F 3/044* (2006.01)
*F24F 13/22* (2006.01)
*F24F 13/02* (2006.01)

(52) U.S. Cl.
CPC ..... *F24F 13/0272* (2013.01); *F24F 13/222* (2013.01); *F24F 2013/221* (2013.01); *F24F 2221/36* (2013.01)

(58) Field of Classification Search
CPC .. F24F 2013/221; F24F 2221/36; F24F 13/20; F24F 13/0245; F24F 13/0272
USPC ..... 454/237
See application file for complete search history.

(56) References Cited

U.S. PATENT DOCUMENTS

| | | | | |
|---|---|---|---|---|
| 5,396,782 | A * | 3/1995 | Ley | F16F 15/04 248/636 |
| 8,186,119 | B1 * | 5/2012 | Huff | F24F 13/20 52/302.3 |
| 2003/0013406 | A1 * | 1/2003 | Herbeck | F24F 3/0442 454/195 |
| 2006/0283657 | A1 * | 12/2006 | Dubensky | F24F 5/0075 181/200 |
| 2007/0151169 | A1 | 7/2007 | Kandasamy | |
| 2007/0290586 | A1 * | 12/2007 | Rosete | F24F 3/0442 312/236 |
| 2009/0056248 | A1 * | 3/2009 | Pflum | F24F 3/0442 52/220.1 |
| 2010/0112930 | A1 * | 5/2010 | Grigsby | F24F 3/0442 454/333 |
| 2013/0092345 | A1 * | 4/2013 | McKie | F24F 12/001 165/7 |

* cited by examiner

PANEL FOR AN AIR HANDLING UNIT, METHOD FOR ASSEMBLING SUCH A PANEL, AND AIR HANDLING UNIT INCLUDING SUCH A PANEL

The present invention relates to a panel for an air handling unit. The present invention further relates to a method for assembling such a panel as well as to an air handling unit including such a panel.

In the field of air handling, it is known to use an air handling unit including a plurality of components, each pertaining to an air handling function. These components are arranged in a structural framework, which ensures the rigidity of the air handling unit. The structural framework defines several surfaces of the unit. On each surface, several panels of small or medium size are placed and attached. These panels are removable, or provided with handles or hinges, so that an operator can remove or open one or more of them and easily perform actions on the components of the air handling unit for maintenance purposes.

On this subject, it is known, for example, from EP-A-2 578 959, to provide each panel with a joining element arranged all around it. According to this approach, the joining element is made of metal and comprises either a male connector or a female connector, so that the panels can be assembled and aligned one with respect to the other. In other words, two types of joining elements have to be manufactured and mounted on the panels, namely a "male" part and a "female" part, which results in relatively high production costs and long assembly times. In addition, such a panel is heavy, which makes the handling of the panel by an operator difficult and dangerous. Thus, the air handling unit that is provided both with such panels and with the structural framework is very heavy.

On this subject, it is known to reduce the size of the panels in order to limit their weight. Consequently, the number of panels mounted on the unit increases. This has negative consequences on the tightness of the unit, since leaks or intrusions of air occur between the panels.

It is these disadvantages that the invention aims to overcome more particularly by proposing a novel panel having dimensions such that it can completely cover a surface of the air handling unit.

In this spirit, the invention relates to a panel for an air handling unit, the panel defining a main axis perpendicular to its surface and including at least two first plates, each provided with at least two folded-over edges, and at least two second plates, each provided with at least two folded-over edges, the plates being parallel to one another and perpendicular to the main axis of the panel. According to the invention, the panel includes at least one internal joining element inserted between the first and the second plates along the main axis.

By means of the invention, the panel has large dimensions and, once mounted, it ensures the rigidity necessary for the air handling unit. In addition, each panel is assembled from light-weight components of reduced dimensions, such as plates and internal joining elements, which can be handled easily by an operator. Thus, such an air handling unit needs no structural framework. This results in advantageous production costs and lighter units. Finally, the number of panels of the unit decreases, which appreciably reduces air leaks between the panels.

According to advantageous but nonobligatory aspects of the invention, such a panel includes one or more of the following features, considered in all the technical acceptable combinations:

- The internal joining element comprises both a first niche and a second niche, and folded-over edges adjacent to two adjacent first plates are arranged in the first niche, and folded-over edges adjacent to two adjacent second plates are arranged in the second niche.
- The internal joining element comprises at least one bore, the first plates each comprise at least one opening aligned with the bore, the bore and the openings being configured to receive the same attachment means.
- Once mounted, the second plates hide the attachment means in place in the openings of the first plates and in the bore of the internal joining element.
- Each second plate is mounted on the internal joining element by means of its own attachment means.
- The adjacent folded-over edges of the adjacent first plates and second plates are provided with a curved end configured to exert a resilient bearing force in the first and second niches.
- The panel includes, in addition, a peripheral joining element arranged around the panel and inserted between the first and second plates along the main axis, nonadjacent folded-over edges of the first and second plates being arranged in respective niches of the peripheral joining element.
- The peripheral joining element comprises both a male assembly device formed by a protruding rib and a female assembly device formed by a hollow groove, and the protruding rib of the peripheral joining element is configured to fit in the hollow groove of another peripheral joining element of identical transverse cross section, belonging to another panel.

The invention further relates to a method for assembling a panel as described above, the method including, at least, steps consisting in:

a) positioning the first plates on the internal joining element, the adjacent folded-over edges of the first plates being arranged in the first niche of the internal joining element;
b) positioning the attachment means of the first plates;
c) positioning the second plates on the internal joining element, the adjacent folded-over edges of the second plates being arranged in the second niche of the internal joining element;
d) positioning attachment means of the second plates on the external joining element.

Finally, the invention relates to an air handling unit including panels and a plurality of components, these components being a ventilation unit, a heating battery and/or a cooling battery, at least one filter, movable slat shutters, a recuperation unit and/or a humidification unit. The unit is characterized in that at least one panel is as described above or assembled as mentioned above.

The invention will be understood better and other advantages of said invention will become clearer in the light of the following description given only as a non-limiting example and in reference to the appended drawings in which.

Figure 1:
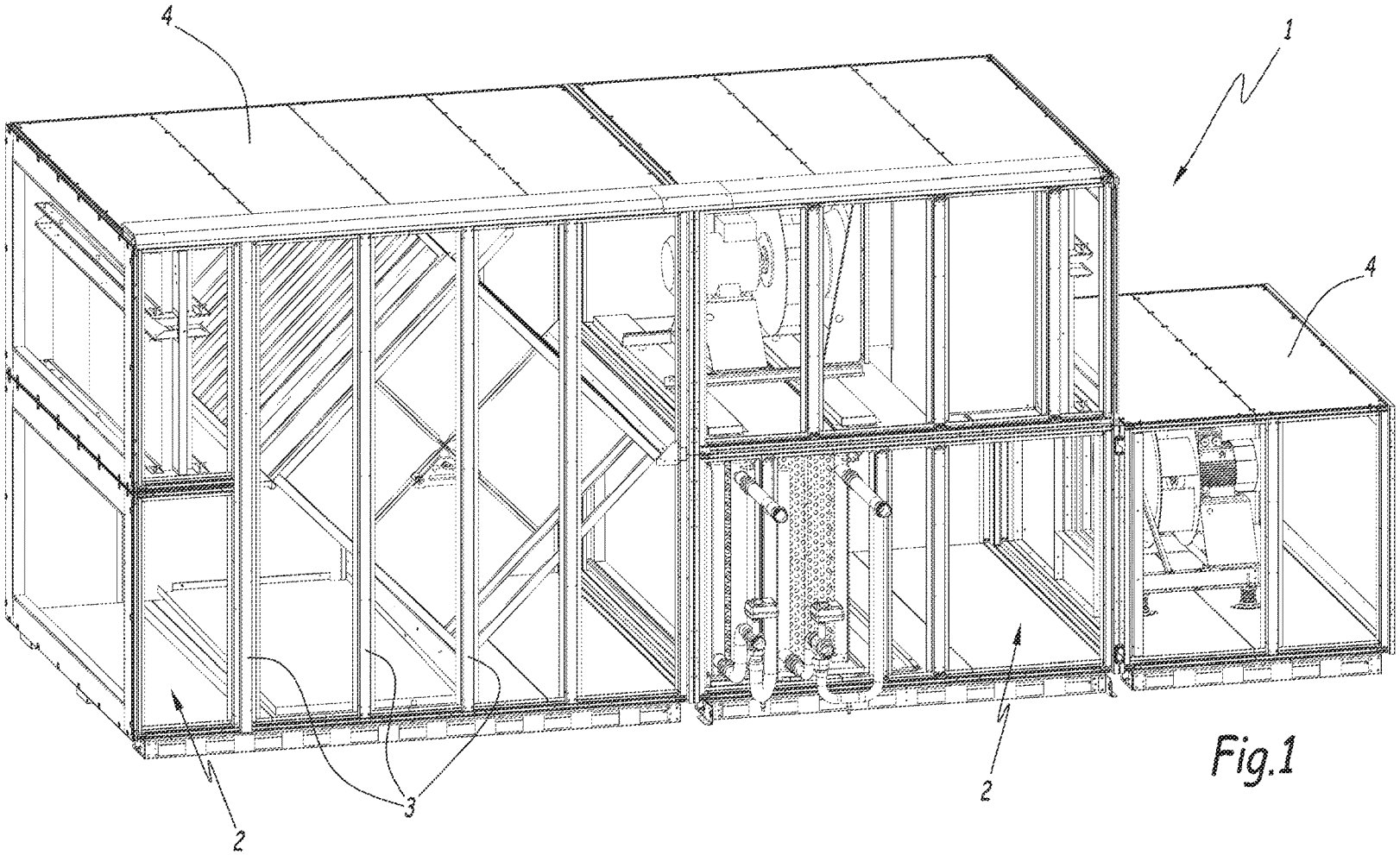
FIG. 1 is a perspective view of an air handling unit from which some panels have been removed.

In FIG. 1, an air handling unit 1 is represented. The unit 1 includes a plurality of modules 2 and a plurality of components. The unit 1 also includes vertical bars 3, which are also referred to as "joining T bars."

The joining T bars 3 are positioned vertically between two modules 2 and are configured to firmly connect panels 6 by means of assembly screws. The joining T bars 3 do not form a structural framework for the unit 1, since they are not sufficiently rigid and resistant to the loads of the unit 1.

Each module 2 of the unit 1 is configured to include at least one component of the unit 1. The components of the unit 1 are, for example, a ventilation unit, a heating battery, a cooling battery, filters, movable slat shutters, a recuperation unit and/or a humidifier.

The ventilation unit is configured to set in motion, or ventilate, the air handled by the unit 1. The ventilation unit functions by means of an electric fan unit including one or more electric motors which are equipped with one or more turbines.

The heating battery is configured to implement the heating of the air handled by the unit 1. In the heating battery, a heat-exchanging fluid circulates, such as water or a gas, for example. In addition, the heating of the air is ensured, for example, by one or more resistors or by a gas-fired boiler.

The cooling battery is configured to implement the cooling of the air handled by the unit 1. In the cooling battery, a heat-exchanging fluid circulates, such as, for example, water or refrigerant liquid.

The filters are configured to implement the filtration of the air handled by the unit 1. The filters used depend on the application of the unit 1.

The shutters with the movable slats are configured to implement the closing and the opening of one or more air circuits of the unit 1. Their function is to enable or to prevent the passage of the air as needed.

The recuperation unit is configured to recuperate the thermal energy of the air handled by the unit 1. The recuperation unit then includes a recuperator such as, for example, a plate recuperator, a rotary recuperator, a thermodynamic recuperator, a heat pipe, or glycolated water batteries.

The humidifier is configured to regulate the humidity of the air handled by the unit 1. The humidifier includes, for example, a system for injecting water in the form of drops or steam in order to ensure the humidification of the air.

The air handling unit 1 comprises several surfaces 4, which have different sizes depending on their position in the unit 1. The surfaces 4 are each covered by a panel 6. Each panel 6 is then of different size, depending on the surface 4 on which it is positioned.

Figure 2:
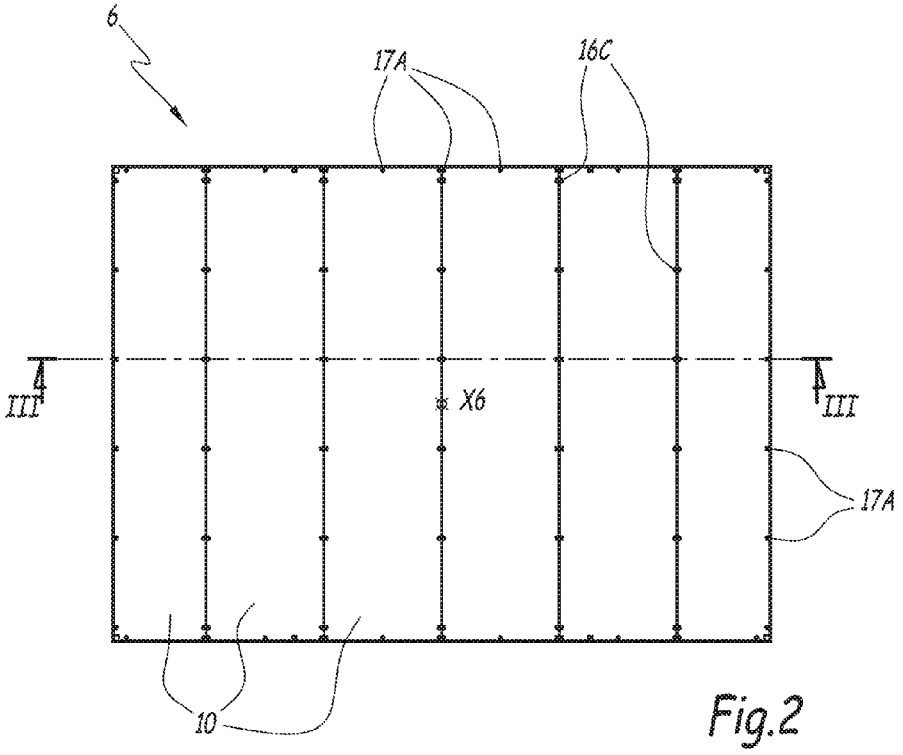
FIG. 2 is a front view of a panel of the air handling unit of FIG. 1.
Figure 6:
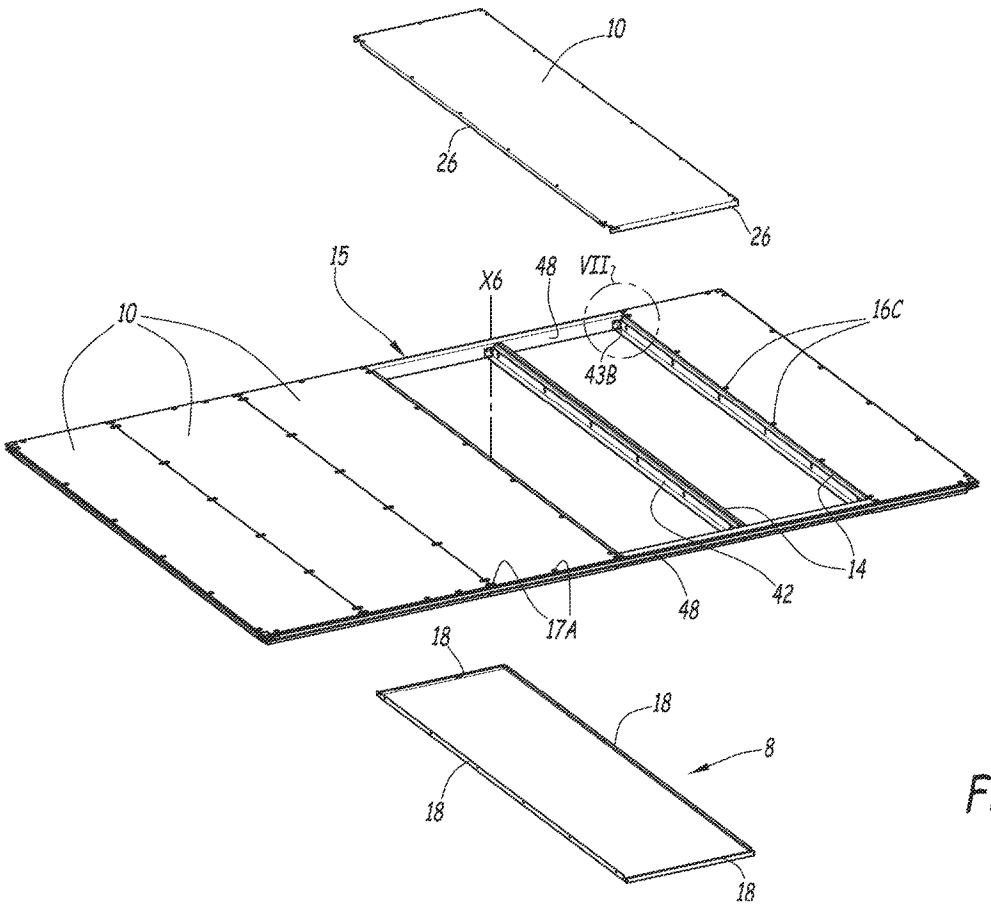
FIG. 6 is a perspective view of the panel in FIG. 2 from which some plates and attachment rivets have been removed.
Figure 7:
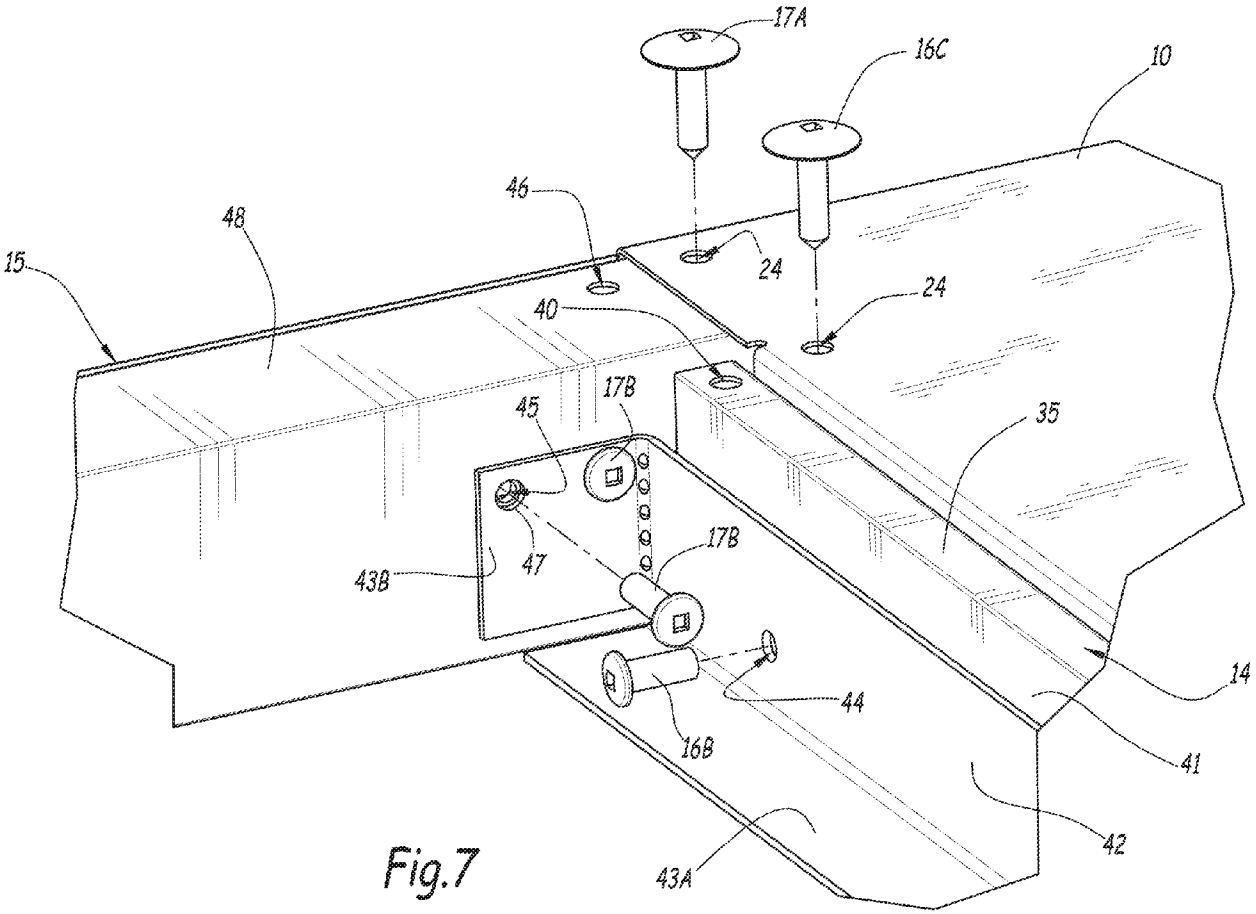
FIG. 7 is a view on a larger scale of Box VII in FIG. 5.

In FIGS. 2 and 6, a panel 6 of the unit 1 is represented. The following description is based on the panel 6 of these FIGS. 2 and 6, but is applicable to any other panel 6, regardless of its size or of the number of its components.

Figure 3:
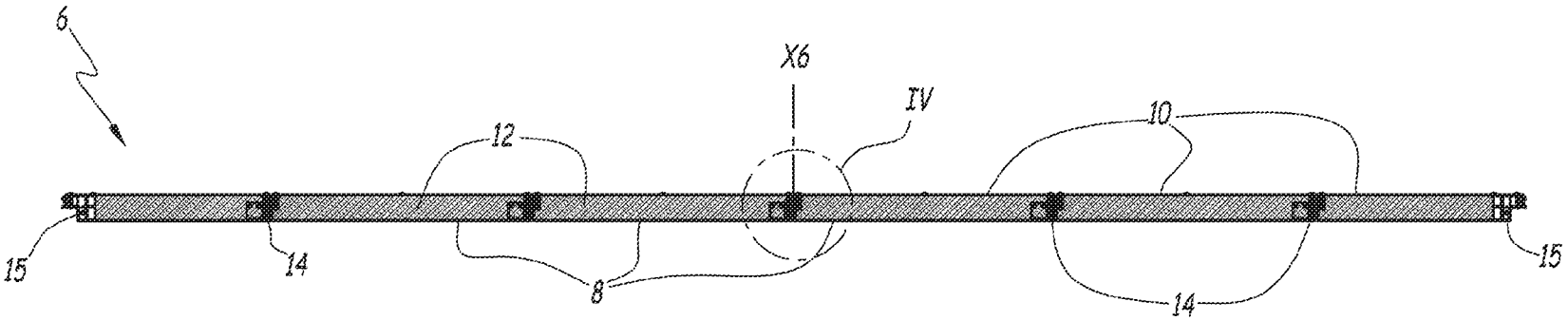
FIG. 3 is a cross section of the panel of FIG. 2 along the plane III-III.
Figure 4:
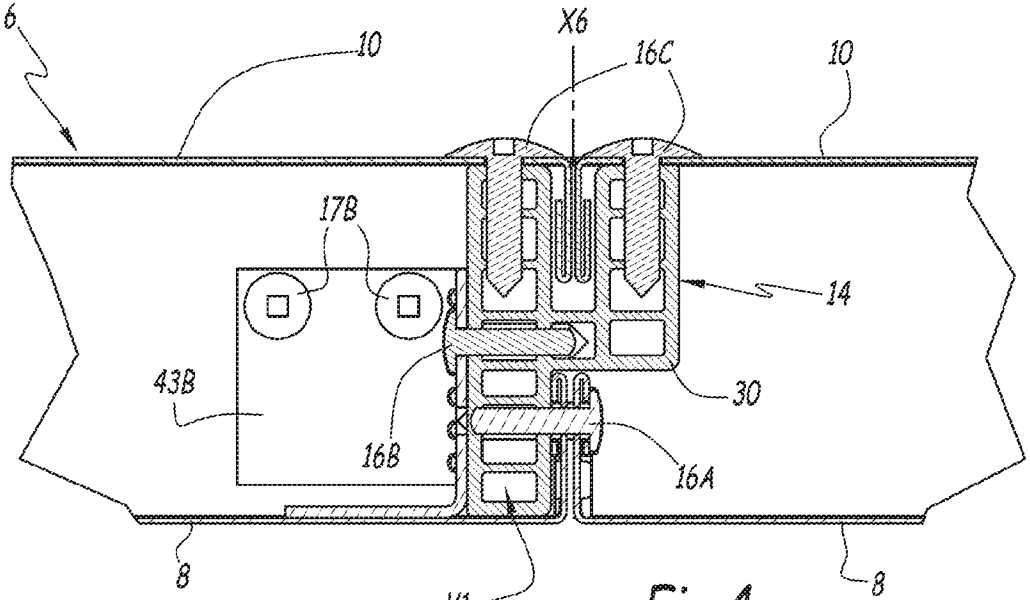
FIG. 4 is a cross section on a larger scale of the Box IV in FIG. 3.
Figure 5:
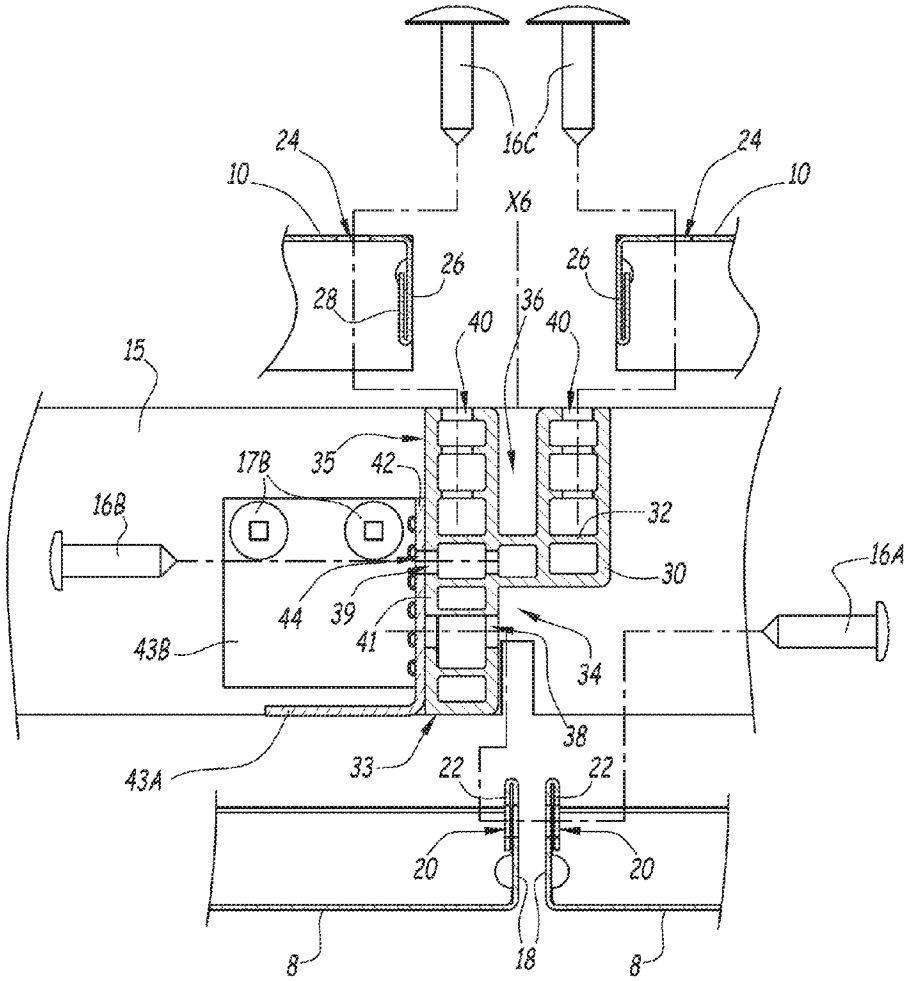
FIG. 5 is an exploded cross section corresponding to the Box IV.

The panel 6 defines a main axis X6 perpendicular to its surface. In addition, the panel 6 includes six first plates 8, six second plates 10, six layers 12 made of insulating material, five internal joining elements 14, a peripheral joining element 15, and a plurality of attachment means 16A, 16B, 16C, 17A and 17B. For the sake of the clarity of the drawing, the layers 12 are represented only in FIG. 3.

The attachment means 16A, 16B, 16C, 17A and 17B are, for example, attachment rivets, as can be seen in the figures.

In a variant which is not shown, some or all the attachment means 16A, 16B, 16C, 17A and/or 17B are screws provided to be arranged in corresponding threads.

The plates 8 and 10 and the layers made of insulating material 12 are parallel to one another and perpendicular to the main axis X6 of the panel 6.

The first plates 8 and the second plates 10 are made of metal. In a variant, the plates 8 and 10 are made of polymer materials.

The first plates 8 are also referred to as interior plates, since they are positioned inside the air handling unit 1 in a mounted configuration of the panel 6 on the unit 1. The second plates 10 are referred to as exterior plates, since they are positioned outside the unit 1 in a mounted configuration of the panel.

Each first plate 8 is provided with four folded-over edges 18. In particular, the folded-over edges 18 of the first plates 8 are oriented parallel to the main axis X6 of the panel 6 and towards the second plates 10. The folded-over edges 18 are divided into longitudinal folded-over edges parallel to the larger dimension of a first plate 8 and transverse folded-over edges perpendicular to this dimension. The longitudinal folded-over edges 18 of each first plate 8 are each provided with an end 22 curved towards the main sheet of this plate and configured to exert a resilient bearing force.

In addition, the longitudinal folded-over edges 18 of the first plates 8 of the panel 6 comprise a plurality of openings 20. Each of the openings 20 is configured to receive an attachment rivet 16A during the assembly of the panel 6.

Each second plate 10 comprises a plurality of openings 24 arranged in its main sheet, along its circumference, and it is provided with four folded-over edges 26. In particular, the folded-over edges 26 of the second plates 10 are oriented parallel to the main axis X6 of the panel 6 and towards the first plates 8. The folded-over edges 26 are divided into longitudinal folded-over edges parallel to the larger dimension of a second plate 10 and transverse folded-over edges perpendicular to this dimension. In addition, the longitudinal folded-over edges 26 of each second plate 10 are each provided with an end 28 curved towards the main sheet of this plate and configured to exert a resilient bearing force.

Each of the openings 24 is configured to receive an attachment rivet 16C during the assembly of the panel 6.

The layers made of insulating material 12 are configured to thermally isolate the panels 6. In practice, the layers 12 are configured to reduce the passage of heat from the interior to the exterior and from the exterior to the interior of the air handling unit 1. To achieve this, the layers 12 are, for example, blocks of fibers, mineral, plant-based or synthetic foam. Each layer made of insulating material 12 is arranged between a first plate 8, a second plate 10, and two internal joining elements 14, or between an internal joining element and the peripheral joining element 15. Each layer made of insulating material 12 is firmly connected, for example, by means of a self-adhesive band, to the corresponding first plate 8 and/or second plate 10.

The internal joining elements 14 and the peripheral joining elements 15 are configured to implement the mounting of a panel 6. Each joining element 14 and 15 is also configured to reduce the passage of heat from the interior to the exterior or from the exterior to the interior of the unit 1.

For this purpose, each internal joining element 14 and 15 is made of thermally insulating material, in particular polymer material.

The internal joining elements 14 and the peripheral joining elements 15 form a structural framework of the unit 1. Such a framework consists exclusively of the joining elements 14 and 15 which are sufficiently rigid and solid to resist the load of the unit 1.

The internal joining elements 14 are inserted between the first plates 8 and the second plates 10 along the main axis X6. Thus, the internal joining elements 14 are configured to firmly connect the first plates 8 and the second plates 10 to one another.

In particular, each internal joining element 14 comprises a profile 30, which defines a closed volume V1 of the internal joining element 14, stiffening ribs 32 arranged inside the closed volume V1, and an angle bar 42 external to the profile 30.

The external angle bar 42 is provided with a sole 43A bearing against the first plate 8, with two tabs 43B bearing against the element 15, and with a plurality of openings 44.

33 is used to designate a first portion of the profile 30 of each element 14 which is configured to bear against the first plates 8. 35 is used to designate a second portion of the profile 30 which is configured to bear against the second plates 10. The profile 30 of the internal joining element 14 defines a first niche 34, at the level of the second portion 33, and a second niche 36, at the level of its second portion 35. Moreover, the profile 30 comprises a plurality of bores 38, 39 and 40.

The bores 38 are produced on the first portion 33 in a direction perpendicular to the axis X6 of the panel 6. During the assembly of the panel 6, the bores 38 are aligned with the openings 20 of the first plates 8. They are configured to receive the first attachment rivets 16A. These rivets 16A firmly connect the plates 8 to the joining element 14.

The bores 39 are produced on a wall 41 of the profile 30 in a direction perpendicular to the axis X6 of the panel 6. The external angle bar 42 bears against the wall 41. During the assembly of the panel 6, the bores 39 are aligned with the openings 44 of the external angle bar 42. They are configured to receive the second attachment rivets 16B. These rivets 16B firmly connect the external angle bar 42 to the profile 30.

The bores 40 are produced on the second portion 35 of the profile 30 in a direction parallel to the axis X6 of the panel 6. During the assembly of the panel 6, the bores 40 are aligned with the openings 24 of the two plates 10. They are configured to receive the third attachment rivets 16C. these rivets 16C firmly connect the plates 10 to the internal joining element 14.

In this example, the first niche 34 of the internal joining element 14 is in the form of a dihedron. It is configured to receive the adjacent longitudinal folded-over edges 18 of two adjacent first plates 8 of the panel 6. During the assembly of the panel 6, these longitudinal folded-over edges 18 are arranged in the first niche 34. In particular, the curved end 22 of a first plate 8 comes in contact with the profile 30 and it exerts a resilient bearing force in the first niche 34, while the curved end 22 of the other first plate 8 comes in contact with the attachment rivets 16A and exerts a resilient bearing force against them. The curved ends 22 are thus provided in order to limit the vibrations or deformations of the first plates 8 and thus to reduce air leaks.

In this example, the second niche 36 is in the form of a groove and is configured to receive the adjacent longitudinal folded-over edges 26 of two adjacent second plates 10 of the panel 6. During the assembly of the panel 6, these longitudinal folded-over edges 26 are arranged in the second niche 36, and the curved ends 28 exert a resilient bearing force in the second niche 36.

Thus, the folded-over edges 18 are immobilized in the first niche 34 by the attachment rivets 16A which are common to the first plates 8, since they pass through their openings 20, while the folded-over edges 26 are immobilized in the second niche 36 by the attachment rivets 16C each of which belongs to a second plate 10, since they pass through a single opening 24.

At the level of the two niches 34 and 36, the curved ends 22 and 28 prevent vibration noises and the leaks.

The peripheral joining element 15 is arranged around the panel 6 and is also inserted between the first and second plates 8 and 10, along the main axis X6. The element 15 comprises a plurality of bores 45 and 46. In addition, attachment rivets 17A and 17B are used in order to firmly connect the plates 8 and 10 and the internal joining elements 14 to the peripheral joining element 15.

The internal joining elements 14 are thus attached on the peripheral joining element 15. In practice, each tab 43B of the external angle bar 42 comprises two openings 47 which, during the assembly of the panel 6, are aligned with two bores 45 of the element 15. The attachment rivets 17B are provided in order to firmly connect the tabs 43B to the joining element 15.

The peripheral joining element 15 comprises four profiles 48 of identical cross sections and of different lengths. The length of the profiles 48 is defined depending on the panel 6 for which they are configured.

The four profiles 48 are thus arranged in the form of a rectangle and four corners are provided to fit with ends of the profiles 48, so as to immobilize the profiles 48 and construct the peripheral joining element 15.

In this case, the panel 6, represented in FIGS. 2 and 6, is rectangular. In practice, the panels 6 can be rectangular or square.

During the mounting of the panel 6, the bores 46 of the peripheral joining element 15 are in correspondence, along the main axis X6, with the openings 20 and 22 of the plates 8 and 10. The attachment rivets 17A are provided in order to firmly connect the plates 8 and 10 to the element 15.

Figure 8:
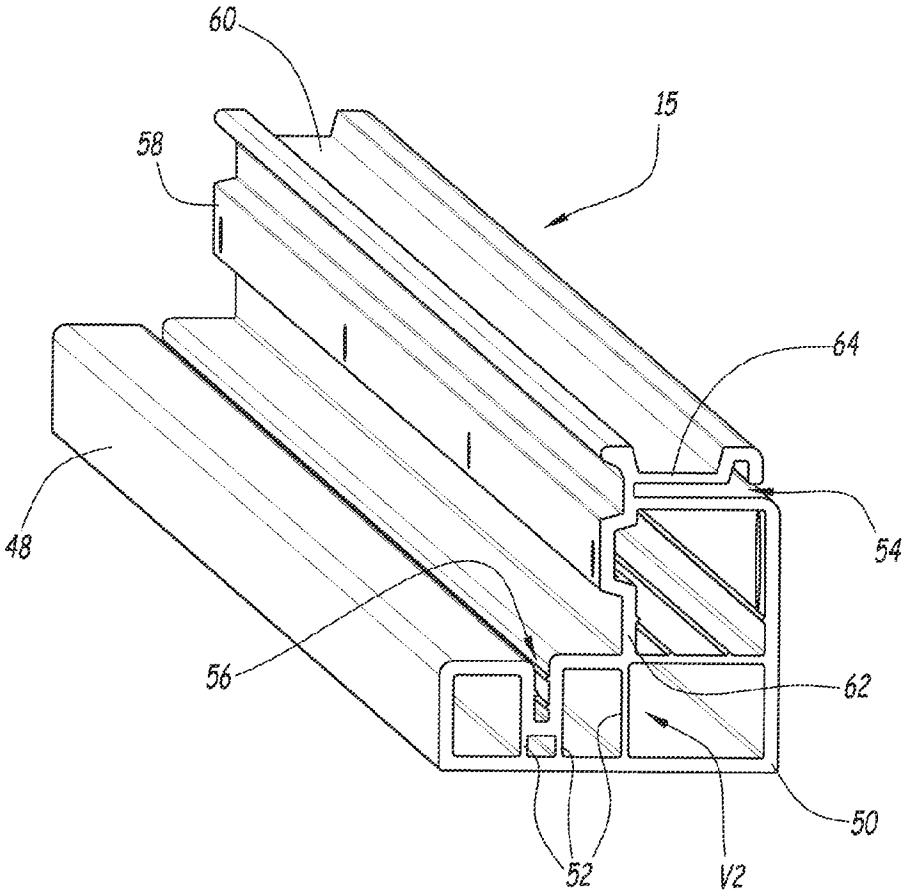
FIG. 8 is a perspective view of a peripheral joining element of the panel in FIG. 2.

In reference to the cross section of a profile 48 represented in FIG. 8, the peripheral joining element 15 comprises an external periphery 50 which defines a closed volume V2 of the peripheral joining element 15. The peripheral joining element 15 also comprises stiffening ribs 52 arranged inside the closed volume V2.

The periphery 50 of the peripheral joining element 15 defines a first niche 54 and a second niche 56.

The first niche 54 receives the transverse folded-over edges 18 of the first plates 8. The second niche 56 is perpendicular to the first niche 54 and receives the transverse folded-over edges 26 of the second plates 10.

In addition, the peripheral joining element 15 comprises both a male assembly device 58 and a female assembly device 60. The male assembly device 58 is formed by a protruding rib, while the female assembly device 60 is formed by a hollow groove.

The protruding rib 58 is produced on a first wall 62 of the periphery 50 of the element 15. This wall 62 is arranged perpendicularly to the main axis X6 of the panel 6 and parallel to the plates 8 and 10.

The hollow groove 60 is provided on a second wall 64 of the periphery 50 of the element 15. The wall 64 is arranged parallel to the main axis X6 of the panel 6 and perpendicularly to the wall 62.

Figure 9:
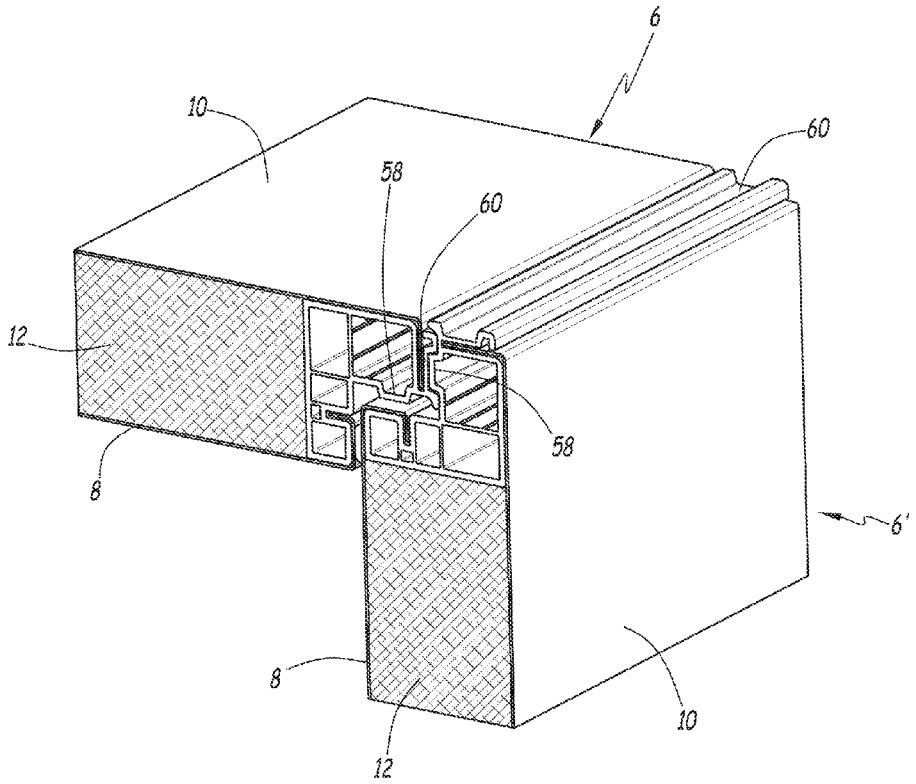
FIG. 9 is a partial perspective view of two panels of the type shown in FIG. 2, in a configuration assembled at right angle.

As shown in FIG. 9, the protruding rib 58 of the peripheral joining element 15 is configured to fit in the hollow groove 60 of another peripheral joining element 15 of identical cross section, belonging to another panel 6'. In particular, the hollow groove 60 of the peripheral joining element 15 of the panel 6' of a first surface 4 receives the protruding rib 58 of the peripheral joining element 15 of the panel 6 of a second surface 4 adjacent to the first surface 4 and perpendicular to it.

According to a variant not shown in the figures, the first niche 34 of the internal joining element 14 is also in the form of a groove and comprises a plurality of bores similar to the bores 38 on its two sides. During the assembly of the panel 6, these bores 38 are aligned with the openings 20 of the first plates 8. Each opening is thus configured for the passage of a tool for positioning an attachment rivet 16A which is positioned in one of the bores 38 and the openings 20 of the adjacent first plates 8.

According to another variant not shown in the figures, the panel 6 comprises no peripheral joining element 15, only the elements 14 being present. In this case, the transverse folded-over edges of the plates 8 and 10 of the panel 6 overlap one another and are firmly connected by means of rivets or staples.

According to yet another variant not shown in the figures, a gap with a thickness parallel to the main axis X6 of the panel 6 is defined between each layer made of insulating material 12 and the corresponding first plate 8 and/or the corresponding second plate 10.

According to yet another variant not shown in the figures, the longitudinal folded-over edges 18 and 26 do not have curved ends.

In order to assemble a panel 6 as described above, an assembly method is used.

This assembly method includes a preliminary step z) consisting in assembling the internal joining elements 14 and peripheral joining elements 15 of the panel 6. In particular, an angle bar 42 is assembled with each internal peripheral element 14 by means of the attachment rivets 16B which are positioned in the openings 44 of the angle bar 42 and the bores 39 of the element 14. Then, the tab 43B of each angle bar 42 is assembled with the peripheral joining element 15 by means of the attachment rivets 17B which are positioned in the openings 47 of the tab 43B and the bores 45 of the element 15. In practice, the attachment rivets 16B and 17B firmly connect the elements 14 to the element 15.

Next, the assembly method includes a step a) consisting in positioning the first plates 8 on the joining elements 14 and 15, the adjacent longitudinal folded-over edges 18 being arranged in the first niche 34 of the internal joining elements 14, and the non-adjacent transverse folded-over edges 18 being arranged in the first niche 54 of the peripheral joining element 15.

Next, the assembly method includes a step b) consisting in positioning attachment rivets 16A in the bores 38 of the element 14 and the corresponding openings 20 of the first plates 8. Access to the attachment rivets 16A is possible, since the second plates 10 have not yet been positioned. In practice, the attachment rivets 16A firmly connect the first plates 8 to the elements 14 and 15.

Next, the assembly method next includes a step c) consisting in positioning the second plates 10 on the joining elements 14 and 15, the adjacent longitudinal folded-over edges 26 being arranged in the second niche 36 of the internal joining elements 14, and the non-adjacent transverse folded-over edges 26 being arranged in the second niche 56 of the peripheral joining element 15. Once mounted, the second plates 10 hide the attachment rivets 16A in place in the openings 20 of the first plates 8 and in the bores 38 of the internal joining element 14.

Finally, the assembly method includes a step d) consisting in positioning the attachment rivets 16C in the bores 40 of the element 14 and the corresponding openings 24 of the second plates 10. Next, attachment rivets 17A are positioned in the bores 46 of the element 15 and the corresponding openings 24. In practice, the attachment rivets 16C and 17A firmly connect the second plates 10 to the elements 14 and 15.

The embodiments and the variants of the above text can be combined to generate new embodiments.

The invention claimed is:

1. An air handling unit including panels and a plurality of components, the components being:

a ventilation unit, a heating battery and/or a cooling battery, at least one filter, movable slat shutters, a thermal recuperator, and/or a humidification unit, at least one of the panels defining a main axis (X6) perpendicular to its surface and including:

at least two first plates, each provided with at least two folded-over edges, and at least two second plates, each provided with at least folded-over edges, the plates being parallel to one another and perpendicular to the main axis of the panel, wherein the panel includes at least one internal joining element inserted between the first plate and the second plate along the main axis (X6), wherein the panel further includes a peripheral joining element arranged around the panel and inserted between the first and second plates along the main axis (X6), nonadjacent folded-over edges of the first and second plates being arranged in respective niches of the peripheral joining element, and wherein the internal joining element and the peripheral joining element form a structural framework of the air handling unit.

2. An air handling unit according to claim 1, characterized in that the internal joining element comprises both a first niche and a second niche, and in that the adjacent folded-over edges of two adjacent first plates are arranged in the first niche, and adjacent folded-over edges of two adjacent second plates are arranged in the second niche.

3. An air handling unit according to claim 1, characterized in that the internal joining element comprises at least one bore, in that the first plates each comprise at least one opening aligned with the bore, the bore and the openings being configured to receive the same attachment means.

4. An air handling unit according to claim 3, characterized in that, once mounted, the two plates hide the attachment means in place in the openings of the first plates and in the bore of the internal joining element.

5. An air handling unit according to claim 3, characterized in that each second plate is mounted on the internal joining element by means of its own attachment means.

6. An air handling unit according to claim 5, characterized in that the adjacent folded-over edges of the adjacent first and second plates are provided with a curved end configured to exert a resilient bearing force in the first and second niches.

7. An air handling unit according to claim 1, characterized in that the peripheral joining element comprises both a male assembly device formed by protruding rib, and a female assembly device formed by a hollow groove, and in that the protruding rib of the peripheral joining element is configured to fit in the hollow groove of another peripheral joining element of identical cross section, belonging to another panel.

8. Method for assembling a panel according to claim 3, the method comprising:

positioning the first plates on the internal joining element, the adjacent folded-over edges of the first plates being arranged in the first niche of the internal joining element;

positioning the attachment means of the first plates;

positioning the second plates on the internal joining element, the adjacent folded-over edges of the second plates being arranged in the second niche of the internal joining element;

positioning the attachment means of the second plates on the internal joining element.

* * * * *